US010068520B2

(12) United States Patent
Xiang et al.

(10) Patent No.: US 10,068,520 B2
(45) Date of Patent: Sep. 4, 2018

(54) ORGANIC LIGHT-EMITTING DISPLAY PANEL AND DRIVING METHOD THEREOF, AND ORGANIC LIGHT-EMITTING DISPLAY DEVICE

(71) Applicant: SHANGHAI TIANMA AM-OLED CO., LTD., Shanghai (CN)

(72) Inventors: Dongxu Xiang, Shanghai (CN); Yue Li, Shanghai (CN); Dong Qian, Shanghai (CN); Gang Liu, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 15/638,024

(22) Filed: Jun. 29, 2017

(65) Prior Publication Data

US 2017/0301286 A1 Oct. 19, 2017

(30) Foreign Application Priority Data

Jan. 25, 2017 (CN) ..... 2017 1 0062713

(51) Int. Cl.
*G09G 3/3208* (2016.01)
*G09G 5/18* (2006.01)
*G09G 3/3233* (2016.01)

(52) U.S. Cl.
CPC ..... *G09G 3/3208* (2013.01); *G09G 3/3233* (2013.01); *G09G 5/18* (2013.01); *G09G 2330/021* (2013.01)

(58) Field of Classification Search
CPC ..... G09G 3/3208; G09G 3/3233; G09G 5/18; G09G 3/3291
(Continued)

(56) References Cited

U.S. PATENT DOCUMENTS 9,035,976 B2 * 5/2015 Lee ..... G09G 3/3283 345/691
9,786,225 B2 * 10/2017 Hyeon ..... G09G 3/3258
(Continued)

FOREIGN PATENT DOCUMENTS

CN 1845229 A1 10/2006
CN 103578411 A1 2/2014
(Continued)

OTHER PUBLICATIONS

Chinese, 1st Office Action dated May 31, 2018.

*Primary Examiner* — Fred Tzeng
(74) *Attorney, Agent, or Firm* — Alston & Bird LLP

(57) ABSTRACT

The present disclosure discloses an organic light-emitting display panel and a driving method thereof, and an organic light-emitting display device. The organic light-emitting display panel comprises a pixel array, a plurality of pixel driving circuits, a plurality of reference voltage signal lines and a plurality of data voltage signal lines. The plurality of pixel driving circuits include a first, second and third pixel driving circuits, the first pixel driving circuit and the second pixel driving circuit are adjacent to each other in a row direction of the pixel array, and the second pixel driving circuit and the third pixel driving circuit are adjacent to each other in the row direction of the pixel array. The first pixel driving circuit and the second pixel driving circuit share one reference voltage signal line, and the second pixel driving circuit and the third pixel driving circuit share one data voltage signal line.

14 Claims, 12 Drawing Sheets

(58) Field of Classification Search
USPC ..... 345/100
See application file for complete search history.

(56) References Cited

U.S. PATENT DOCUMENTS

| | | | | |
|---|---|---|---|---|
| 9,934,728 | B2 * | 4/2018 | Han | G09G 3/3258 |
| 2008/0111812 | A1 * | 5/2008 | Shirasaki | G09G 3/3233 345/212 |
| 2011/0090200 | A1 * | 4/2011 | Choi | G09G 3/3233 345/211 |
| 2011/0109299 | A1 * | 5/2011 | Chaji | G09G 3/3283 324/76.11 |
| 2013/0257839 | A1 * | 10/2013 | Hyeon | G06F 3/038 345/212 |
| 2015/0123883 | A1 * | 5/2015 | Lin | G09G 3/3233 345/76 |
| 2015/0130785 | A1 * | 5/2015 | Shin | G09G 3/3233 345/213 |
| 2016/0098960 | A1 * | 4/2016 | Park | G09G 3/3233 345/205 |
| 2016/0117988 | A1 * | 4/2016 | Lee | G09G 3/3233 345/205 |

FOREIGN PATENT DOCUMENTS

| | | | |
|---|---|---|---|
| CN | 104809986 | A1 | 7/2015 |
| CN | 106710525 | A1 | 5/2017 |

* cited by examiner

600

ORGANIC LIGHT-EMITTING DISPLAY PANEL AND DRIVING METHOD THEREOF, AND ORGANIC LIGHT-EMITTING DISPLAY DEVICE

CROSS-REFERENCE TO RELATED APPLICATION

This application is related to and claims priority from Chinese Patent Application No. CN201710062713.4, filed on Jan. 25, 2017, entitled "Organic Light-Emitting Display Panel and Driving Method Thereof, and Organic Light-Emitting Display Device," the entire disclosure of which is hereby incorporated by reference for all purposes.

TECHNICAL FIELD

The present application relates to the technical field of display, and particularly to an organic light-emitting display panel and a driving method thereof, and an organic light-emitting display device.

BACKGROUND

As display technologies develop continuously, dimensions and specification of displays are changing rapidly. To satisfy portability of electronic devices, there are increasing demands for display screens with smaller dimensions and specification.

At the same time, users raise higher requirements for display quality of display screens. For example, users are inclined to display screens with a high PPI (Pixels per Inch) to improve display accuracy and coherence.

OLED (Organic Light-emitting Diodes) displays are applied to various portable electronic apparatuses more and more extensively as having advantages such as light weight, slimness and power saving.

An OLED display usually comprises an organic light-emitting diode array (namely, a pixel array), a driving circuit (namely, a pixel circuit) providing a driving current to organic light-emitting diodes in the array, a scanning circuit providing a driving signal to the pixel circuits, and the like.

However, from the circuit structures of the current pixel circuits, each column of pixel circuits needs a data voltage signal line and a reference voltage signal line. Furthermore, generally, the data voltage signal lines and the reference voltage signal lines extend along a column direction (longitudinal direction) of the pixel array. That is to say, an organic light-emitting display panel having M rows×N columns of pixel arrays needs total 2N longitudinal wires. As such, a larger number of longitudinal wires on the panel makes implementation of the high PPI of the organic light-emitting display panel difficult.

It is desired to provide a solution to the technical problem mentioned above.

SUMMARY

In a first aspect, embodiments of the present disclosure provide an organic light-emitting display panel, comprising: a pixel array comprising pixel regions in M rows and N columns; a plurality of pixel driving circuits, each pixel driving circuit comprising a light-emitting diode and a driving transistor for driving the light-emitting diodes; a plurality of reference voltage signal lines for providing a reference voltage signal to each pixel driving circuit; a plurality of data voltage signal lines for providing a data voltage signal to each pixel driving circuit; the plurality of pixel driving circuits include a first pixel driving circuit, a second pixel driving circuit and a third pixel driving circuit, the first pixel driving circuit and the second pixel driving circuit are adjacent to each other in a row direction of the pixel array, the second pixel driving circuit and the third pixel driving circuit are adjacent to each other in the row direction of the pixel array; the first pixel driving circuit and the second pixel driving circuit share one reference voltage signal line, and the second pixel driving circuit and the third pixel driving circuit share one data voltage signal line; the organic light-emitting display panel further comprises a first control signal line and a second control signal line, the first pixel driving circuit and the third pixel driving circuit, under control of a first control signal input by the first control signal line, receive the reference voltage signal and the data voltage signal and control the light-emitting diodes in the first pixel driving circuit and the third pixel driving circuit to turn on, and the second pixel driving circuit, under control of a second control signal input by the second control signal line, receives the reference voltage signal and the data voltage signal and controls the light-emitting diode in the second pixel driving circuit to turn on.

In a second aspect, embodiments of the present disclosure further provide an organic light-emitting display device comprising the organic light-emitting display panel.

In a third aspect, embodiments of the present disclosure further provide a driving method for driving the organic light-emitting display panel. The driving method comprises: in a first phase, providing a first level signal to the first control signal line, providing a second level signal to the second control signal line, providing a first initialization signal to each of the data voltage signal lines electrically connected with the first pixel driving circuit and third pixel driving circuit, and thereby performing initialization and threshold detection for the first pixel driving circuit and third pixel driving circuit; in a second phase, providing a first level signal to the first control signal line, providing a second level signal to the second control signal line, providing a reference voltage signal to the reference voltage signal line, and providing a first data signal for compensating a threshold voltage of the driving transistor of the first pixel driving circuit or third pixel driving circuit to the data voltage signal lines electrically connected with the first pixel driving circuit and third pixel driving circuit, respectively; in a third phase, providing a second level signal to the first control signal line, providing a first level signal to the second control signal line, providing a first initialization signal to the data voltage signal line electrically connected with the second pixel driving circuit, thereby performing initialization and threshold detection for the second pixel driving circuit, and emitting light by light-emitting diodes in the first pixel driving circuit and third pixel driving circuit based on the first data signal; in a fourth phase, providing a second level signal to the first control signal line, providing a first level signal to the second control signal line, providing a reference voltage signal to the reference voltage signal line, and providing a second data signal for compensating a threshold voltage of the driving transistor of the second pixel driving circuit, to the data voltage signal line electrically connected with the second pixel driving circuit; in a fifth phase, emitting light by the light-emitting diode in the second pixel driving circuit based on the second data signal.

In a fourth aspect, embodiments of the present disclosure further provide a driving method for driving the aforesaid organic light-emitting display panel. The driving method comprises: in a first collecting phase of the threshold detection phase, providing a first level signal to the first control signal line, providing a second level signal to the second control signal line, providing a first initialization signal to the data voltage signal lines electrically connected with the first pixel driving circuit and third pixel driving circuit, respectively, thereby performing initialization and threshold detection for the first pixel driving circuit and third pixel driving circuit; in a second collecting phase of the threshold detection phase, providing a second level signal to the first control signal line, providing a first level signal to the second control signal line, providing a first initialization signal to the data voltage signal line electrically connected with the second pixel driving circuit, thereby performing initialization and threshold detection for the second pixel driving circuit.

According to solutions of the present disclosure, the number of data voltage signal lines and reference voltage signal lines in the organic light-emitting display panel may be reduced, which facilitates implementation of the high PPI of the organic light-emitting display panel. In addition, during operation of the organic light-emitting display panel, the reference voltage signal line always maintains the reference voltage signal so that the load on the reference voltage signal line is reduced and power consumption of the organic light-emitting display panel is reduced.

In another aspect, in some optional implementation modes of the present disclosure, the threshold voltage of the driving transistor in the pixel driving circuits sharing the reference voltage signal line is collected in a time division manner through the reference voltage signal line, thereby performing compensator for the threshold voltage of the driving transistor, and improving uniformity of display luminance of the organic light-emitting display panel.

In addition, in some optional implementation modes of the present disclosure, collecting the threshold voltage of the driving transistor in the pixel driving circuits sharing the reference voltage signal line in a time division manner through the reference voltage signal line may avoid excessive changes of the amplitude of the signal transmitted on the reference voltage signal line Vref and data voltage signal line Vdata, and thereby reduce the load of the organic light-emitting display panel and power consumption of an integrated circuit which provides the voltage signal to the data voltage signal line Vdata and reference voltage signal line Vref. Meanwhile, since changes of the amplitude of the signal transmitted on the signal lines are not large, it is possible to reduce parasitic capacitance on the signal lines upon signal switching, and correspondingly quicken the transmission speed of the voltage signal on the signal lines.

BRIEF DESCRIPTION OF THE DRAWINGS

Other features, objects, and advantages of the present application will become more apparent upon reading the following detailed description of the non-limiting embodiments with reference to the accompanying drawings, in which.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

An organic light-emitting display panel according to the present disclosure comprises a pixel array, a plurality of pixel driving circuits, a plurality of reference voltage signal lines and a plurality of data voltage signal lines.

The pixel array may comprise pixel regions in M rows and N columns.

Each pixel driving circuit may comprise light-emitting elements (e.g., light-emitting diodes) and a driving transistor for driving the light-emitting diodes, the light-emitting diodes being located in each pixel region. In some optional implementation modes, the pixel driving circuits may correspond one-to-one with the pixel regions, that is to say, each pixel region includes one pixel driving circuit corresponding thereto. Or, in other optional implementation modes, adjacent pixel driving circuits may share a portion of electric elements (e.g., driving transistor), and the light-emitting diodes in adjacent pixel regions are respectively turned on by providing a data signal to the driving transistor in a time-division manner.

The reference voltage signal line maybe used to provide a reference voltage signal to each pixel driving circuit. The data voltage signal line may be used to provide a data voltage signal to each pixel driving circuit.

There exist a first pixel driving circuit, a second pixel driving circuit and a third pixel driving circuit in the plurality of pixel driving circuits of the organic light-emitting display panel of the present disclosure.

Figure 1:
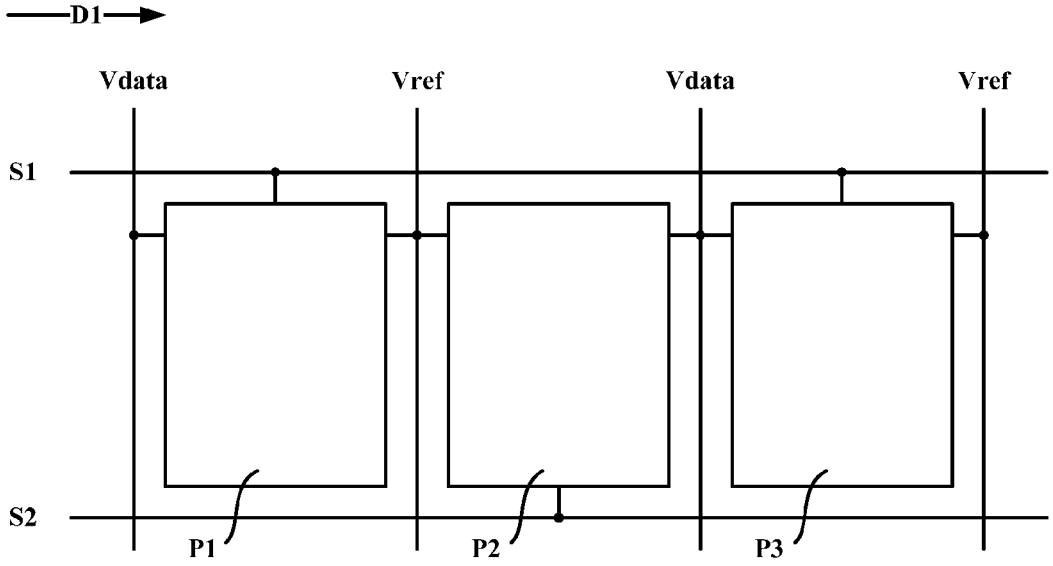
FIG. 1 illustrates a schematic structural view of an embodiment of a first pixel driving circuit, a second pixel driving circuit and a third pixel driving circuit in an organic light-emitting display panel according to the present disclosure.

Reference is made to FIG. 1 which illustrates a schematic structural view of an embodiment including a first pixel driving circuit, a second pixel driving circuit and a third pixel driving circuit in an organic light-emitting display panel according to the present disclosure.

In FIG. 1, the first pixel driving circuit P1 and the second pixel driving circuit P2 are adjacent in a row direction D1 of the pixel array, and the second pixel driving circuit P2 and the third pixel driving circuit P3 are also adjacent in a row direction D1 of the pixel array.

The first pixel driving circuit P1 and the second pixel driving circuit P2 share one reference voltage signal line Vref, and the second pixel driving circuit P2 and the third pixel driving circuit P3 share one data voltage signal line Vdata.

In addition, in the present disclosure, the organic light-emitting display panel further comprises a first control signal line S1 and a second control signal line S2. The first pixel driving circuit P1 and the third pixel driving circuit P3, based on control of a first control signal input by the first control signal line S1, receive the reference voltage signal and the data voltage signal, and turn on the light-emitting diode in the first pixel driving circuit P1 and the light-emitting diode in the third pixel driving circuit P3.

The second pixel driving circuit P2, based on control of a second control signal input by the second control signal line S2, receives the reference voltage signal and the data voltage signal, and turns on the light-emitting diode in the second pixel driving circuit.

In the first pixel driving circuit P1, the second pixel driving circuit P2 and the third pixel driving circuit P3 as shown in FIG. 1, the first pixel driving circuit P1 and the third pixel driving circuit P3, through the first control signal input by the first control signal line S1, control the write of the data signal and turn on the light-emitting diodes in the first pixel driving circuit P1 and third pixel driving circuit P3. The second pixel driving circuit P2, through the second control signal input by the second control signal line S2, controls the write of the data signal and turns on the light-emitting diode in the second pixel driving circuit.

In addition, the first pixel driving circuit P1, the second pixel driving circuit P2 and the third pixel driving circuit P3 as shown in FIG. 1 need to share altogether two voltage signal lines and two reference voltage signal lines. The number of data voltage signal lines and reference voltage signal lines is reduced, which facilitates implementation of a high PPI organic light-emitting display panel. In addition, during operation, the reference voltage signal line always maintains the reference voltage signal so that the load on the reference voltage signal line is reduced and power consumption of the organic light-emitting display panel is also reduced.

Figure 2:
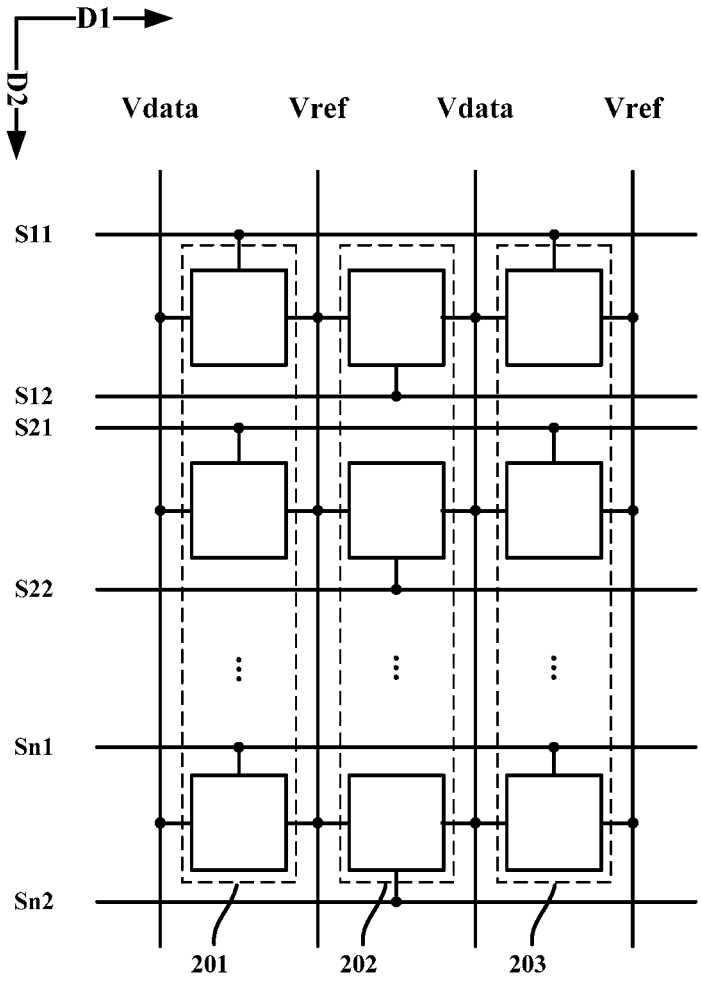
FIG. 2 illustrates a schematic structural view of an embodiment of a first pixel column, a second pixel column and a third pixel column in an organic light-emitting display panel according to the present disclosure.

Referring to FIG. 2, FIG. 2 illustrates a schematic structural view of an embodiment of a first pixel column, a second pixel column and a third pixel column in an organic light-emitting display panel according to the present disclosure.

The pixel array of the organic light-emitting display panel according to the present disclosure comprises at least one pixel sub-array as shown in FIG. 2.

The pixel sub-array comprises a first pixel column 201, a second pixel column 202 and a third pixel column 203, wherein the first pixel column 201 is adjacent to the second pixel column 202, and the second pixel column 202 is adjacent to third pixel column 203.

The first pixel driving circuit is used to drive one pixel region in the first pixel column 201, the second pixel driving circuit is used to drive one pixel region in the second pixel column 202, and the third pixel driving circuit is used to drive one pixel region in the third pixel column 203.

For example, each of the pixel regions in the first pixel column 201 is provided with one first pixel driving circuit, each of the pixel regions in the second pixel column 202 is provided with one second pixel driving circuit, and each of the pixel regions in the third pixel column 203 is provided with one third pixel driving circuit.

The pixel driving circuits for driving the pixel regions in the respective pixel columns may, under control of the first control signal or second control signal, receive a reference voltage signal transmitted through the reference voltage signal line, and receive the data voltage signal transmitted through the data voltage signal line.

Specifically, in the first pixel column 201, the first pixel driving circuits located in the first row of pixel regions, through the first control signal input by the first control signal line S11, control the data signal to be written and the light-emitting diodes in these pixel regions to turn on; in the second pixel column 202, the second pixel driving circuits located in the first row of pixel regions, through the second control signal input by the second control signal line S12, control the data signal to be written and the light-emitting diodes in these pixel regions to turn on; in the third pixel column 203, the third pixel driving circuits located in the first row of pixel regions, through the first control signal input by the first control signal line S11, control the data signal to be written and the light-emitting diodes in these pixel regions to turn on.

Similarly, in the first pixel column 201, the first pixel driving circuits located in the second row of pixel regions, through the first control signal input by the first control signal line S21, control the data signal to be written and the light-emitting diodes in these pixel regions to turn on; in the second pixel column 202, the second pixel driving circuits located in the second row of pixel regions, through the second control signal input by the second control signal line S22, control the data signal to be written and the light-emitting diodes in these pixel regions to turn on; in the third pixel column 203, the third pixel driving circuits located in the second row of pixel regions, through the first control signal input by the first control signal line S21, control the data signal to be written and the light-emitting diodes in these pixel regions to turn on. In the first pixel column 201, the first pixel driving circuits located in the $n^{th}$ row of pixel regions, through the first control signal input by the first control signal line Sn1, control the data signal to be written and the light-emitting diodes in these pixel regions to turn on; in the second pixel column 202, the second pixel driving circuits located in the $n^{th}$ row of pixel regions, through the second control signal input by the second control signal line Sn2, control the data signal to be written and the light-emitting diodes in these pixel regions to turn on; in the third pixel column 203, the third pixel driving circuits located in the $n^{th}$ row of pixel regions, through the first control signal input by the first control signal line Sn1, control the data signal to be written and the light-emitting diodes in these pixel regions to turn on.

As such, the pixel circuits in the same column of pixel regions use the same reference voltage signal line and the same data voltage signal line to transmit the reference voltage signal and the data voltage signal respectively, and adjacent columns of pixel regions share one reference voltage signal line (e.g., the first pixel column and second pixel column) or one data voltage signal line (e.g., the second pixel column and third pixel column), the number of data voltage signal lines and reference voltage signal lines in the organic light-emitting display panel is reduced, which facilitates implementation of a high PPI organic light-emitting display panel. In addition, during operation, the reference voltage signal line always maintains the reference voltage signal level so that the load on the reference voltage signal line is reduced and also power consumption of the organic light-emitting display panel is reduced.

Figure 3A:
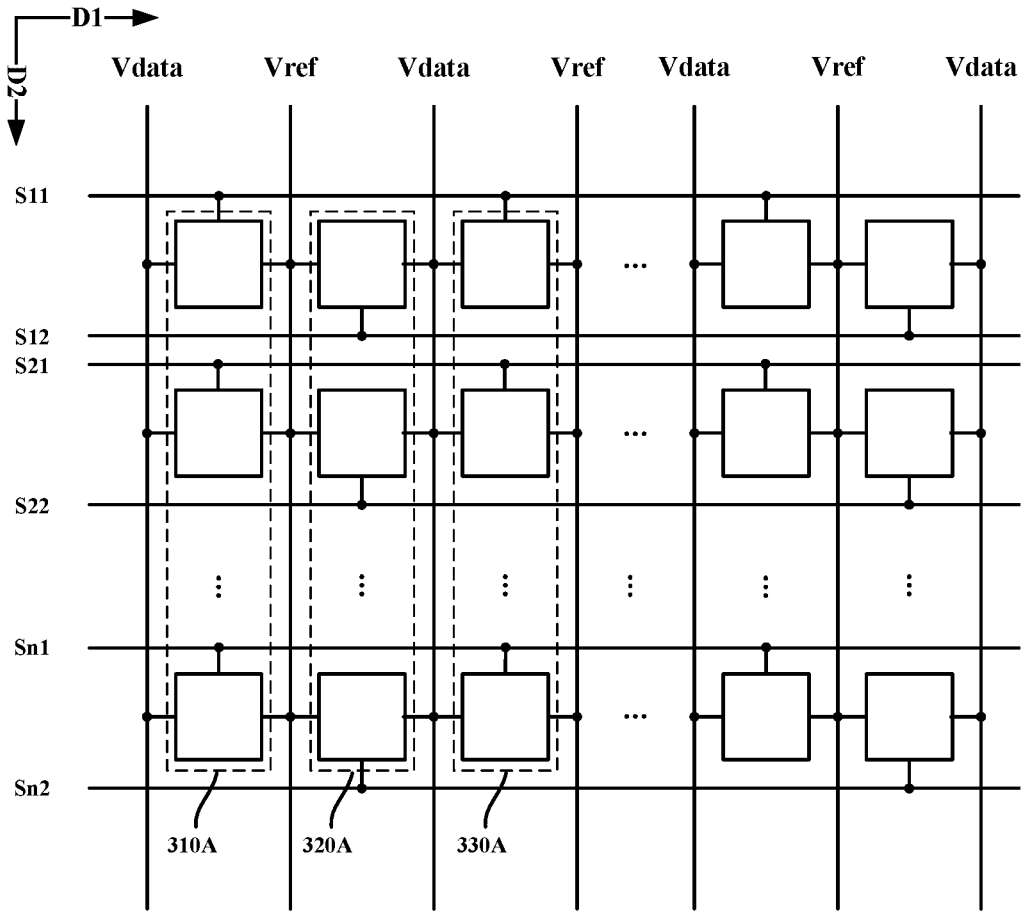
FIG. 3A illustrates a schematic structural view of an embodiment of an organic light-emitting display panel according to the present disclosure.

Referring to FIG. 3, FIG. 3A illustrates a schematic structural view of an embodiment of an organic light-emitting display panel according to the present disclosure.

The organic light-emitting display panel according to the present embodiment also comprises a pixel array, a plurality of pixel driving circuits, a plurality of reference voltage signal lines and a plurality of data voltage signal lines, wherein, the pixel array may comprise pixel regions in M rows and N columns. Each pixel driving circuit may comprise light-emitting elements (e.g., light-emitting diodes) and a driving transistor for driving the light-emitting diodes, the light-emitting diodes being located in each pixel region. The reference voltage signal lines may be used to provide a reference voltage signal to each pixel driving circuit. The data voltage signal lines may be used to provide a data voltage signal to each pixel driving circuit.

In addition, in the organic light-emitting display panel according to the present embodiment, any pixel column in the pixel array is one of a first pixel column, a second pixel column and a third pixel column, and any first pixel column is not adjacent to any third pixel column. As such, the arrangement of the pixel array may be as shown in FIG. 3A, that is to say, a first column 310A in the pixel array may be the first pixel column, a second column 320A may be the second pixel column, and a third column 330A may be the third pixel column, and so on so forth.

Figure 3B:
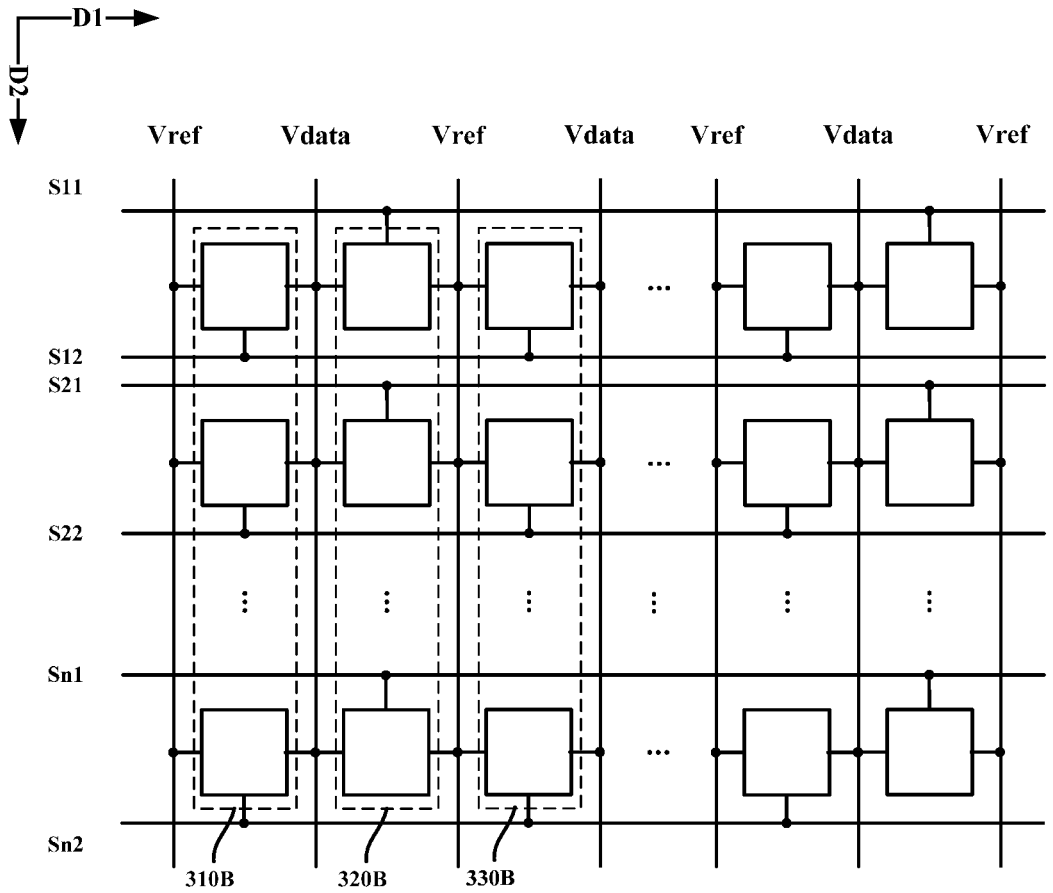
FIG. 3B illustrates a schematic structural view of another optional implementation mode of the embodiment shown in FIG. 3A.

Or, in some other optional implementation modes, the arrangement of the pixel array may be as shown in FIG. 3B, that is to say, a first column 310B in the pixel array may be the third pixel column, a second column 320B may be the second pixel column, and a third column 330B may be the first pixel column.

As can be seen from FIG. 3A and FIG. 3B and the above depictions, in the organic light-emitting display panel according to the present embodiment, the pixel driving circuits in any pixel column of the pixel array and a pixel column adjacent to the pixel column share one data voltage signal line or reference voltage signal line. Furthermore, when the pixel array in the organic light-emitting display panel according to the present embodiment has N pixel columns, in the second to $(N-1)^{th}$ pixel columns, the pixel driving circuits in any pixel column share one data voltage signal line with a pixel column adjacent to the pixel column and share one reference voltage signal line with another adjacent pixel column.

In this way, when the pixel array in the organic light-emitting display panel according to the present embodiment has N pixel columns, because sharing signal lines between adjacent columns, the total number of the reference voltage signal lines and data voltage signal lines of the whole display panel is N+1, thereby substantially reducing the number of longitudinal (namely, the D2 direction as shown in FIG. 3A and FIG. 3B) wires of the organic light-emitting display panel, making the spacing between two adjacent pixel regions in the first direction D1 smaller, and facilitating the implementation of a high PPI organic light-emitting display panel.

Figure 4A:
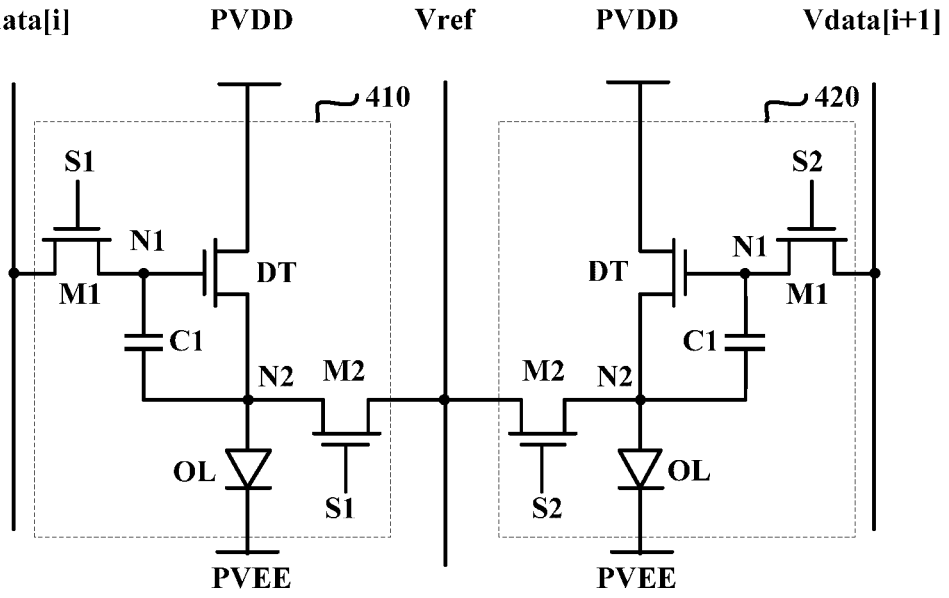
FIG. 4A illustrates a schematic circuit diagram of two pixel driving circuits sharing one reference voltage signal line in an organic light-emitting display panel according to the present disclosure.

Referring to FIG. 4A, FIG. 4A illustrates a schematic circuit diagram of two pixel driving circuits sharing one reference voltage signal line in an organic light-emitting display panel according to the present disclosure.

In FIG. 4A, a pixel driving circuit 410 and a pixel driving circuit 420 for example may respectively be the first pixel driving circuit and second pixel driving circuit described above, and they both share one reference voltage signal line Vref.

In addition, the pixel driving circuit 410 and pixel driving circuit 420 each may include a first transistor M1, a driving transistor DT, a second transistor M2 and a first capacitor C1.

Wherein, a first electrode of the driving transistor DT is electrically connected with a first voltage input signal line PVDD, and a second electrode of the driving transistor DT is electrically connected with a second electrode of the second transistor M2 and an anode of the light-emitting diode OL. The first electrode of the first transistor M1 is electrically connected with the reference voltage signal line Vref, and a second electrode of the first transistor M1 is electrically connected with a gate of the driving transistor DT. A first electrode of the second transistor M2 is electrically connected with the data voltage signal line Vdata.

Both electrode plates of the first capacitor C1 are respectively connected with the gate of the driving transistor DT and the second electrode of the second transistor M2. A cathode of the light-emitting diode OL is electrically connected with a second voltage signal line PVEE.

Figure 4B:
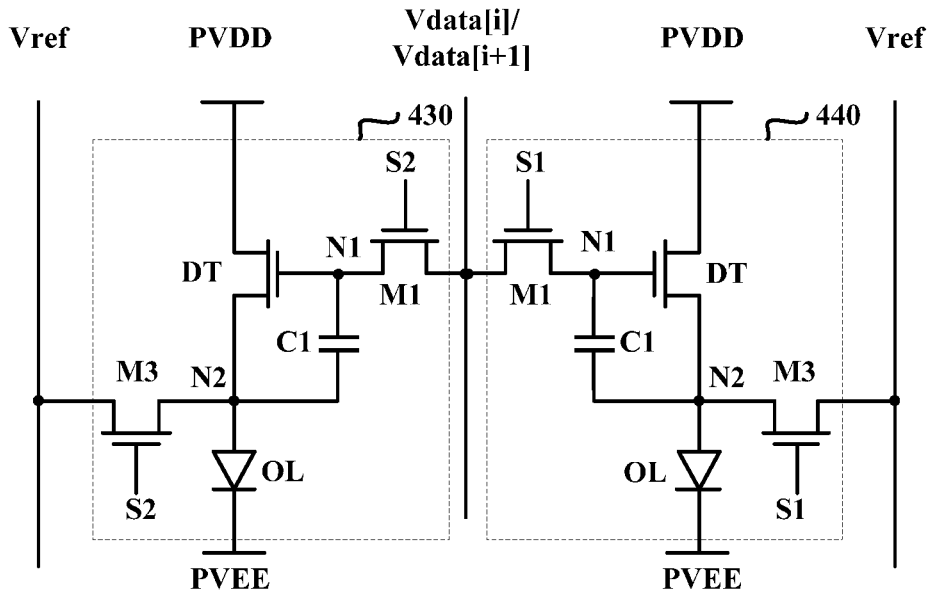
FIG. 4B illustrates a schematic circuit diagram of two pixel driving circuits sharing one data voltage signal line in an organic light-emitting display panel according to the present disclosure.

Reference is made to FIG. 4B which illustrates a schematic circuit diagram of two pixel driving circuits sharing one data voltage signal line in an organic light-emitting display panel according to the present disclosure.

In FIG. 4B, a pixel driving circuit 430 and a pixel driving circuit 440 for example may respectively be the second pixel driving circuit and third pixel driving circuit described above, and they both share one reference voltage signal line Vref. The specific structures of the pixel driving circuit 430 and the pixel driving circuit 440 may be similar to the structures of the pixel driving circuits 410, 420 in FIG. 4A, and are not detailed any more here.

It needs to be appreciated that as shown in FIG. 4A and FIG. 4B, in the organic light-emitting display panel in the present disclosure, two pixel driving circuits (e.g., the pixel driving circuit 410 and pixel driving circuit 420 shown in FIG. 4A) sharing the reference voltage signal line Vref may be in mirror symmetry about the reference voltage signal line shared by the two. Similarly, two pixel driving circuits (e.g., the pixel driving circuit 430 and pixel driving circuit 440 shown in FIG. 4B) sharing the reference voltage signal line Vdata may be in mirror symmetry about the data voltage signal line shared by the two. As such, in the organic light-emitting display panel, wirings in respective pixel driving circuits may get shorter correspondingly, thereby reducing mutual interference between internal wirings of the pixel driving circuits, facilitating further reducing the area of layout occupied by the pixel driving circuits, and thereby facilitating the implementation of a high PPI organic light-emitting display panel.

In addition, in the first pixel driving circuit (e.g., the pixel driving circuit 410 in FIG. 4A) and third pixel driving circuit (e.g., the pixel driving circuit 440 in FIG. 4B) in the organic light-emitting display panel of the present embodiment, the gate of the first transistor M1 and the gate of the second transistor M2 are electrically connected with the first control signal line S1.

In the second pixel driving circuit (e.g., the pixel driving circuit 420 in FIG. 4A or pixel driving circuit 430 in FIG. 4B), the gate of the first transistor M1 and the gate of the second transistor M2 are electrically connected with the second control signal line S2.

Figure 5A:
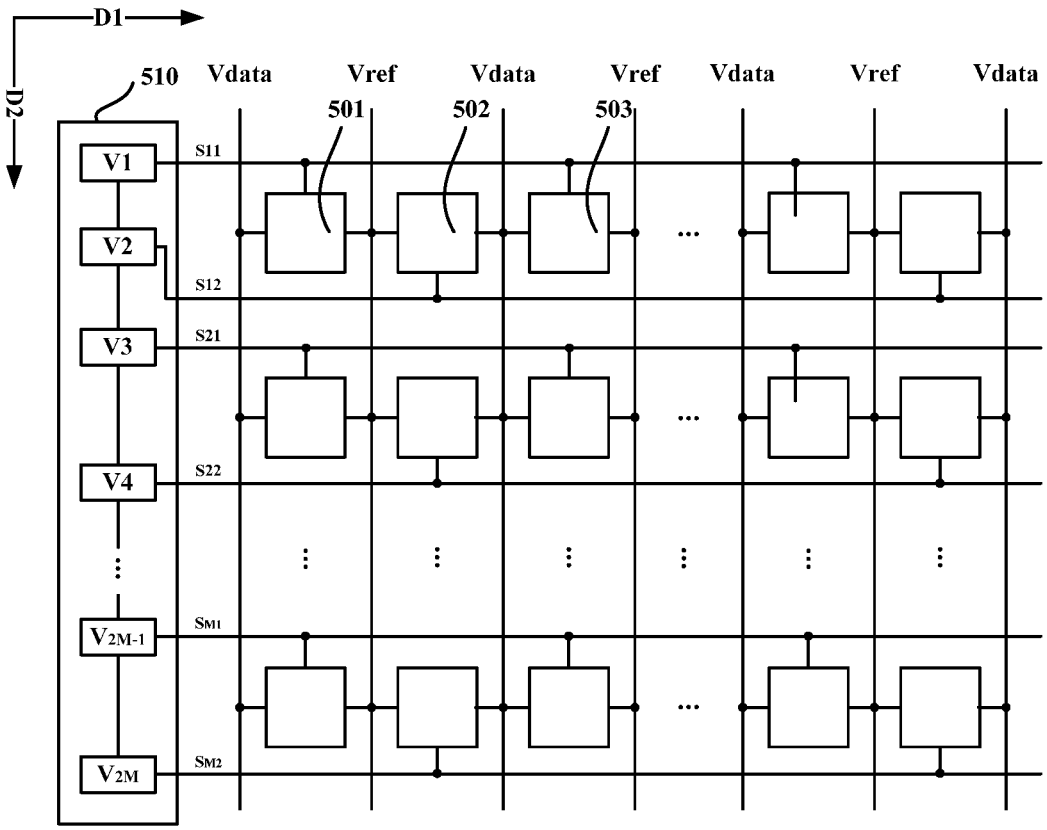
FIG. 5A illustrates a schematic structural view of another embodiment of an organic light-emitting display panel according to the present disclosure.

Reference is made to FIG. 5A which illustrates a schematic structural view of another embodiment of an organic light-emitting display panel according to the present disclosure.

Different from the embodiments shown in FIG. 3A and FIG. 3B, the organic light-emitting display panel in the present embodiment further comprises a shift register 510.

The shift register 510 comprises a plurality of cascaded shift register units V1–V2M. Each shift register unit is electrically connected with one of the first control signal line or second control signal line.

Wherein, the first pixel driving circuit and third pixel driving circuit in the same row are electrically connected with the same first control signal line, and the second pixel driving circuits in the same row are electrically connected with the same second control signal line. For example, the first pixel driving circuit 501 and third pixel driving circuit 503 are electrically connected with the first control signal line S11 (namely, the output terminal of the shift register unit V1). In the first row, the second pixel driving circuit 502 is electrically connected with the second control signal line S12 (namely, the output terminal of the shift register unit V2).

As such, the shift register unit 510 outputs the control signal level by level so that the organic light-emitting display panel may be enabled to display row by row.

For example, in some optional implementation modes, the $k^{th}$ shift register unit is used to provide the first control signal to the first control signal line of the $i^{th}$ row, and the $(k+1)^{th}$ shift register unit is used to provide the first control signal to the second control signal line of the $i^{th}$ row, wherein $1 \le i \le M$. As shown in FIG. 5A, the first shift register unit V1 maybe used to provide the first control signal to the first control signal line S11 of the first row, whereas the second shift register unit v2 may be used to provide the second control signal to the second control signal line S12 of the first row. In the same way, the $(2M-1)^{th}$ shift register unit $V_{2M-1}$ may be used to provide the first control signal to the first control signal line $S_{M1}$ of the $M^{th}$ row, and the $2M^{th}$ shift register unit may be used to provide the second control signal to the second control signal line $S_{M2}$ of the $M^{th}$ row. Or, in some other optional implementation modes of the organic light-emitting display panel of the present embodiment, the signal transmitted on the first control signal line is the same as the signal transmitted on the second control signal line. In some optional implementation modes, as shown in FIG. 5B, the first control signal line of the $i+1^{th}$ line is multiplexed into the second control signal line of the $i^{th}$ row.

Figure 5B:
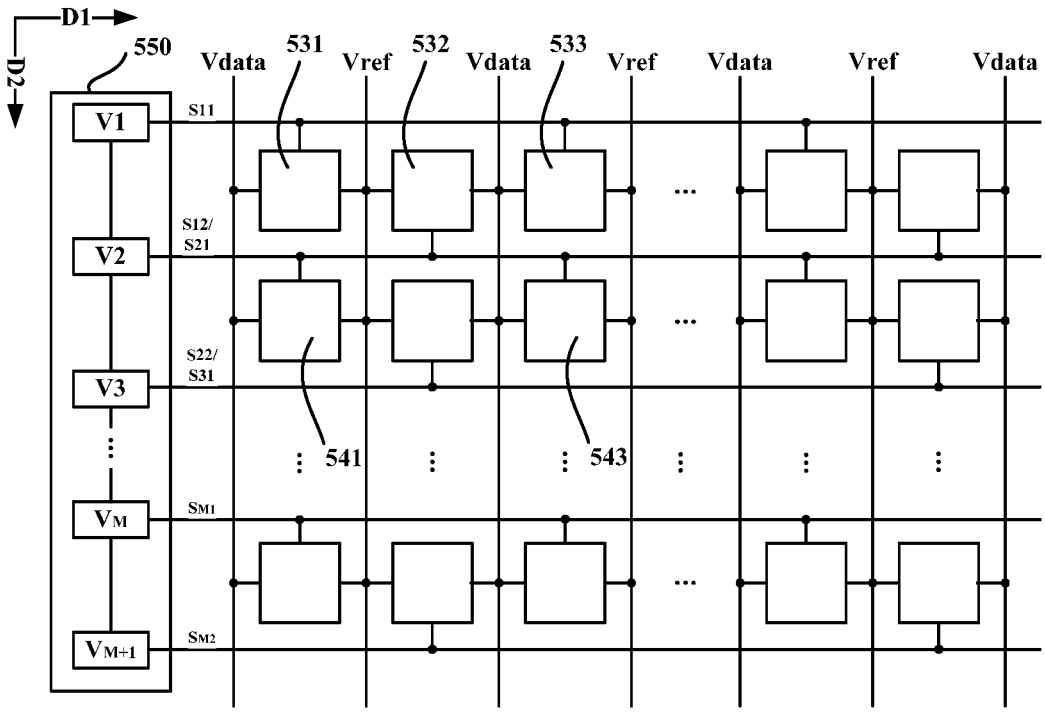
FIG. 5B illustrates a schematic structural view of another optional implementation mode of the organic light-emitting display panel shown in FIG. 5A.

Specifically, in the first row of the organic light-emitting display panel shown in FIG. 5B, the first pixel driving circuit 531 and third pixel driving circuit 533 are electrically connected with the first control signal line (namely, an output terminal of the shift register unit V1), and the second pixel driving circuit 532 is electrically connected with the second control signal line (namely, an output terminal of the shift register unit V2); since the second control signal line in the preceding row is multiplexed as the first control signal line of the current row, the first pixel driving circuit 541 and third pixel driving circuit 543 in the second row are electrically connected with the first control signal line (namely, an output terminal of the shift register unit V2). As such, the number of levels of shift register units needed by the shift registers 550 may be substantially reduced. For example, when the pixel array of the organic light-emitting display panel has n rows, the shift register 550 only needs n+1 levels of shift register units. In this way, electrical elements of the shift register 550 are substantially reduced, and correspondingly, the occupied area of layout is also substantially reduced. On the other hand, as the shift register is usually disposed in a non-display area of the organic light-emitting display panel, substantial reduction of the occupied area of layout facilitates implementation of narrow rims of the organic light-emitting display panel.

Figure 6:
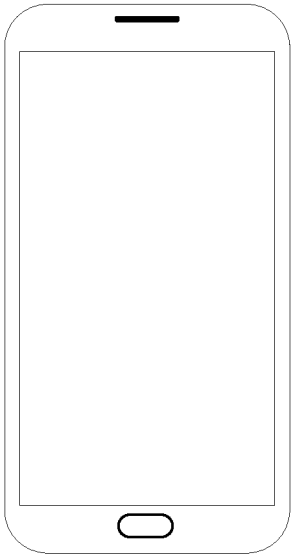
FIG. 6 illustrates a schematic structural view of an embodiment of an organic light-emitting display device according to the present disclosure.

The present disclosure further provides an organic light-emitting display device. As shown in FIG. 6, the organic light-emitting display device 600 comprises the organic light-emitting display panel of the above embodiments, and may be a mobile phone, a tablet computer, a wearable device or the like. It may be appreciated that the organic light-emitting display device 600 may further comprise known structures such as a packaging film and protective glass, which is not detailed any more here.

The organic light-emitting display panel according to embodiments of the present disclosure may be applied to a top emission organic light-emitting display device as well as a bottom emission organic light-emitting display device. Therefore, the organic light-emitting display device according to the present disclosure may be a top emission organic light-emitting display device or a bottom emission organic light-emitting display device.

In addition, the present disclosure further discloses a method of driving the organic light-emitting display panel, which may be used to drive the organic light-emitting display panel described in the above embodiments.

Figure 7:
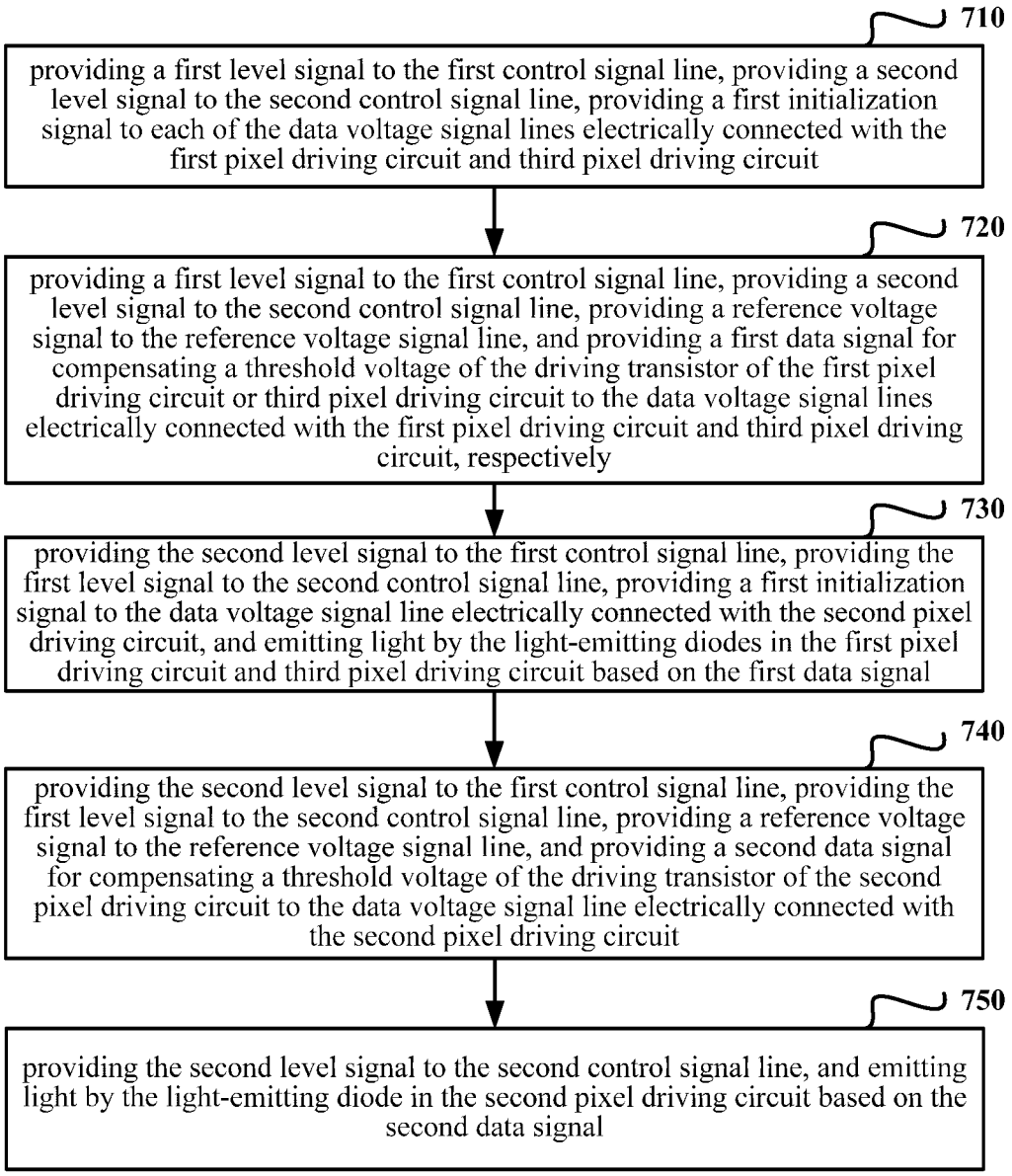
FIG. 7 illustrates a schematic flow chart of an embodiment of a driving method according to the present disclosure.

Reference is made to FIG. 7 which illustrates a schematic flow chart of an embodiment of a driving method according to the present disclosure.

The driving method according to the present embodiment comprises:

Step 710: in a first phase, providing a first level signal to the first control signal line, providing a second level signal to the second control signal line, providing a first initialization signal to the data voltage signal line electrically connected with the first pixel driving circuit and third pixel driving circuit respectively, and thereby performing initialization and threshold detection for the first pixel driving circuit and third pixel driving circuit.

Step 720: in a second phase, providing a first level signal to the first control signal line, providing a second level signal to the second control signal line, providing a reference voltage signal to the reference voltage signal line, and providing a first data signal for compensating a threshold voltage of the driving transistor of the first pixel driving circuit or third pixel driving circuit, to the data voltage signal line electrically connected with the first pixel driving circuit and third pixel driving circuit respectively.

Step 730: in a third phase, providing a second level signal to the first control signal line, providing a first level signal to the second control signal line, providing a first initialization signal to the data voltage signal line electrically connected with the second pixel driving circuit, thereby performing initialization and threshold detection for the second pixel driving circuit, and meanwhile, light-emitting diodes in the first pixel driving circuit and third pixel driving circuit emitting light based on the first data signal.

Step 740: in a fourth phase, providing a second level signal to the first control signal line, providing a first level signal to the second control signal line, providing a reference voltage signal to the reference voltage signal line, and providing a second data signal for compensating a threshold voltage of the driving transistor of the second pixel driving circuit, to the data voltage signal line electrically connected with the second pixel driving circuit.

Step 750: in a fifth phase, providing a second level signal to the second control signal line, the light-emitting diode in the second pixel driving circuit emitting light based on the second data signal.

Figure 8:
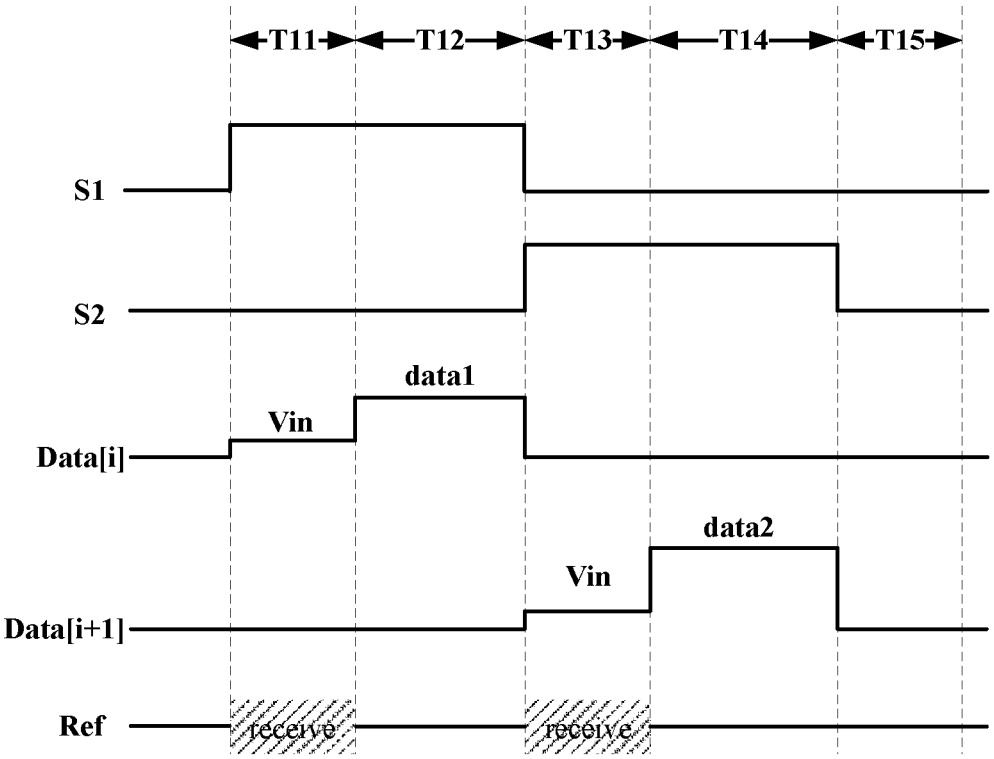
FIG. 8 illustrates a schematic time sequence diagram of the driving method shown in FIG. 7.

Hereunder, the working procedure of the driving method of the present embodiment is further described in conjunction with the structural diagram shown in FIG. 4A and the time sequence shown in FIG. 8. Illustration is presented below by taking an example in which the first level is a high level, the second level is a high level, and transistors in the pixel driving circuits each are an NMOS transistor.

The first phase T11 is a detection phase of a threshold voltage Vth1 of the driving transistor DT in the pixel driving circuit 410 in FIG. 4A. Here, the pixel driving circuit 410 maybe the aforesaid first pixel driving circuit or third pixel driving circuit.

In the first phase T11, the first level signal is provided to the first control signal line S1, the second level signal is provided to the second control signal line S2, and a first initialization signal Vin is provided to the data voltage signal line Vdata (e.g., the data voltage signal line Vdata[i] in FIG. 4A). The first transistor M1 in the pixel driving circuit 410 is turned on, a potential of node N1 in the pixel driving circuit 410 VN1=Vin, and then the driving transistor DT in the pixel driving circuit 410 is turned on. The first voltage signal line PVDD charges the second electrode (node N2) of the driving transistor DT in the pixel driving circuit 410 until the potential of the node N2 rises to Vin−Vth, the driving transistor DT in the pixel driving circuit 410 is turned off, whereupon the first voltage signal line PVDD stops charging. Then, the reference voltage signal line Vref is used to sample the potential of the second electrode (node N2) of the driving transistor DT in the pixel driving circuit 410 VN2=Vin−Vth1, to determine the threshold voltage Vth1 of the driving transistor DT in the pixel driving circuit 410. Here, Vin is a known potential, and it is possible to calculate the threshold voltage Vth1 of the driving transistor DT in the pixel driving circuit 410.

The second phase T12 is a data signal write phase of the pixel driving circuit 410. In the second phase T12, a first level signal is provided to the first control signal line S1, a second level signal is provided to the second control signal line S2, a reference voltage signal Vref is provided to the reference voltage signal line Vref, a first data signal data1 for compensating the threshold voltage vth1 of the driving transistor DT in the pixel driving circuit 410 is provided to the data voltage signal line Vdata (e.g., the data voltage signal line Vdata[i] in FIG. 4A), the reference voltage signal Vref is transmitted to the second electrode (node N2) of the driving transistor DT in the pixel driving circuit 410, and the first data signal data1 is transmitted to the gate (node N1) of the driving transistor DT in the pixel driving circuit 410. At this time, the potential of node N1 VN1=data1, and the potential of node N2 VN2=VRef.

The third phase T13 is a phase of detection of the threshold voltage Vth2 of the driving transistor DT in the pixel driving circuit 420 in FIG. 4A and light emission of the light-emitting diode in the pixel driving circuit 410. In the third phase T13, a second level signal is provided to the first control signal line S1, a first level signal is provided to the second control signal line S2, a first initialization signal is provided to the data voltage signal line Vdata (e.g., the data voltage signal line Vdata[i+1] in FIG. 4A), the first transistor in the pixel driving circuit 420 is turned on, the potential VN1 of node N1 in the pixel driving circuit 420 VN1=Vin, the first voltage signal line PVDD charges the second electrode (node N2) of the driving transistor DT in the pixel driving circuit 420 until the potential of node N2 rises to Vin−Vth2, whereupon the driving transistor DT is turned off, and the first voltage signal line PVDD stops charging; then, the reference voltage signal line Vref (e.g., the data voltage signal line Vdata [i+1] in FIG. 4) is used to the potential VN2 of the second electrode (node N2) of the driving transistor DT in the pixel driving circuit 420 VN2=Vin−Vth2 to determine the threshold voltage of the driving transistor DT in the pixel driving circuit 420. Since Vin is a known potential, it is possible to calculate the threshold voltage Vth2 of the driving transistor DT in the pixel driving circuit 420. At the same time, since there exists a voltage difference between a gate voltage and a source voltage of the driving transistor DT in the pixel driving circuit 410, the light-emitting diode OL in the pixel driving circuit 410, due to the action of the potential difference of node N1 and node N2, is turned on and emits light, and the light-emitting electrical current $I1=K1\times(VN1-VN2)^2=K1\times(data1-VRef)^2$.

The fourth phase T14 is a data signal write phase of the pixel driving circuit 420. In the fourth phase T14, a second level signal is provided to the first control signal line S1, a first level signal is provided to the second control signal line S2, a reference voltage signal is provided to the reference voltage signal line Vref, and a second data signal data2 for compensating a threshold voltage Vth2 of the driving transistor DT of the pixel driving circuit 420, to the data voltage signal line Vdata (e.g., the data voltage signal line Vdata[i+1] in FIG. 4A), the second data signal data2 is transmitted to the gate (node N1) of the driving transistor DT in the pixel driving circuit 420, the reference voltage signal VRef is transmitted to the second electrode (node N2) of the driving transistor DT in the pixel driving circuit 420, whereupon the potential of node N1 VN1=data2, and the potential of node N2 VN2=VRef.

The fifth phase T15 is a light-emitting phase of the light-emitting diode in the pixel driving circuit 420. In the fifth phase, a second level signal is provided to the second control signal line S2, and the light-emitting diode OL in the pixel driving circuit 420, due to the action of the potential difference of node N1 and node N2, is turned on and emits light, and the light-emitting electrical current $I2=K2\times(VN1\times VN2)^2=K2\times(data2-VRef)^2$.

In the first phase T11 and second phase T12, the second control signal line S2 transmits the second level signal and turns off the second transistor M2 in the pixel driving circuit 420. In T11 or T12, the pixel driving circuit 420 does not affect the signal of the reference voltage signal line Vref, that is, the threshold voltage Vth1 of the driving transistor DT in the pixel driving circuit 410 collected by the reference voltage signal line Vref does not undergo interference of the pixel driving circuit 420, and the reference voltage signal transmitted by the reference voltage signal line Vref to the second electrode (node N2) of the driving transistor DT in the pixel driving circuit 410 does not undergo interference of the pixel driving circuit 420.

Likewise, in the third phase T13 and fourth phase T14, the collection of the threshold voltage of the driving transistor DT in the pixel driving circuit 420 and write of the second data signal is not affected by the pixel driving circuit 410.

In addition, as can be seen from the above depictions, the driving method shown in FIG. 7 may use an external circuit to implement compensation for the threshold voltage of the driving transistor, and the reference voltage signal line Vref respectively collects the potential of node N2 in the two pixel driving circuits connected therewith in the first phase and third phase.

In addition, the driving method of the present embodiment is employed to avoid excessive changes of the amplitude of the signal transmitted on the reference voltage signal line Vref and data voltage signal line Vdata, and thereby reduce the load of the organic light-emitting display panel and power consumption of an integrated circuit which provides the voltage signal to the data voltage signal line Vdata and reference voltage signal line Vref. Meanwhile, since changes of the amplitude of the signal transmitted on the signal lines are not large, it is possible to reduce parasitic capacitance on the signal lines upon signal switching, and correspondingly quicken the transmission speed of the voltage signal on the signal lines.

Figure 9:
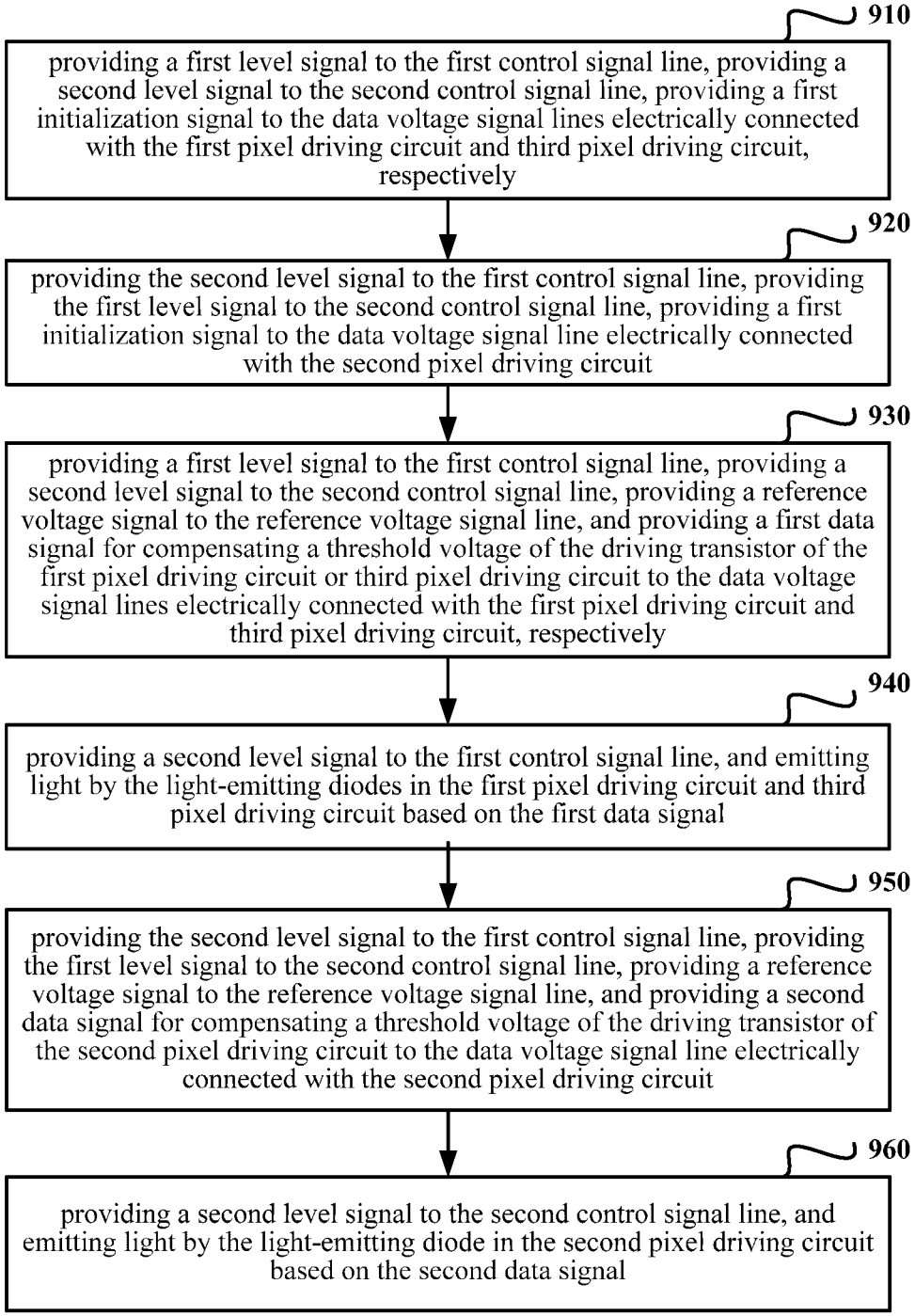
FIG. 9 illustrates a schematic flow chart of the driving method according to another embodiment of the present disclosure.

Reference is made to FIG. 9 which illustrates a schematic flow chart of the driving method according to another embodiment of the present disclosure. The driving method shown in FIG. 9 can also be used to drive the organic light-emitting display panel described in the above embodiments.

The driving method according to the present embodiment includes:

Step 910: in a first collecting phase of the threshold detection phase, providing a first level signal to the first control signal line, providing a second level signal to the second control signal line, providing a first initialization signal to the data voltage signal line electrically connected with the first pixel driving circuit and third pixel driving circuit respectively, and thereby performing initialization and threshold detection for the first pixel driving circuit and third pixel driving circuit.

Step 920: in a second collecting phase of the threshold detection phase, providing a second level signal to the first control signal line, providing a first level signal to the second control signal line, providing a first initialization signal to the data voltage signal line electrically connected with the second pixel driving circuit, and thereby performing initialization and threshold detection for the second pixel driving circuit.

The threshold voltage of the driving transistor in the first pixel driving circuit, second pixel driving circuit and third pixel driving circuit may be collected respectively through the first collecting phase and the second collecting phase.

Furthermore, in some optional implementation modes, the driving method of the present embodiment may further comprise the following steps:

Step 930: in a first data signal write phase in the display phase, providing a first level signal to the first control signal line, providing a second level signal to the second control signal line, providing a reference voltage signal to the reference voltage signal line, and providing a first data signal for compensating a threshold voltage of the driving transistor of the first pixel driving circuit or third pixel driving circuit, to the data voltage signal line electrically connected with the first pixel driving circuit and third pixel driving circuit.

Step 940: in a first light-emitting phase, providing a second level signal to the first control signal line, the light-emitting diodes in the first pixel driving circuit and third pixel driving circuit emitting light based on the first data signal.

Step 950: in a second data signal write phase in the display phase, providing a second level signal to the first control signal line, providing a first level signal to the second control signal line, providing a reference voltage signal to the reference voltage signal line, and providing a second data signal for compensating a threshold voltage of the driving transistor of the second pixel driving circuit, to the data voltage signal line electrically connected with the second pixel driving circuit.

Step 960: in a second light-emitting phase, providing a second level signal to the second control signal line, the light-emitting diode in the second pixel driving circuit emitting light based on the second data signal.

Figure 10:
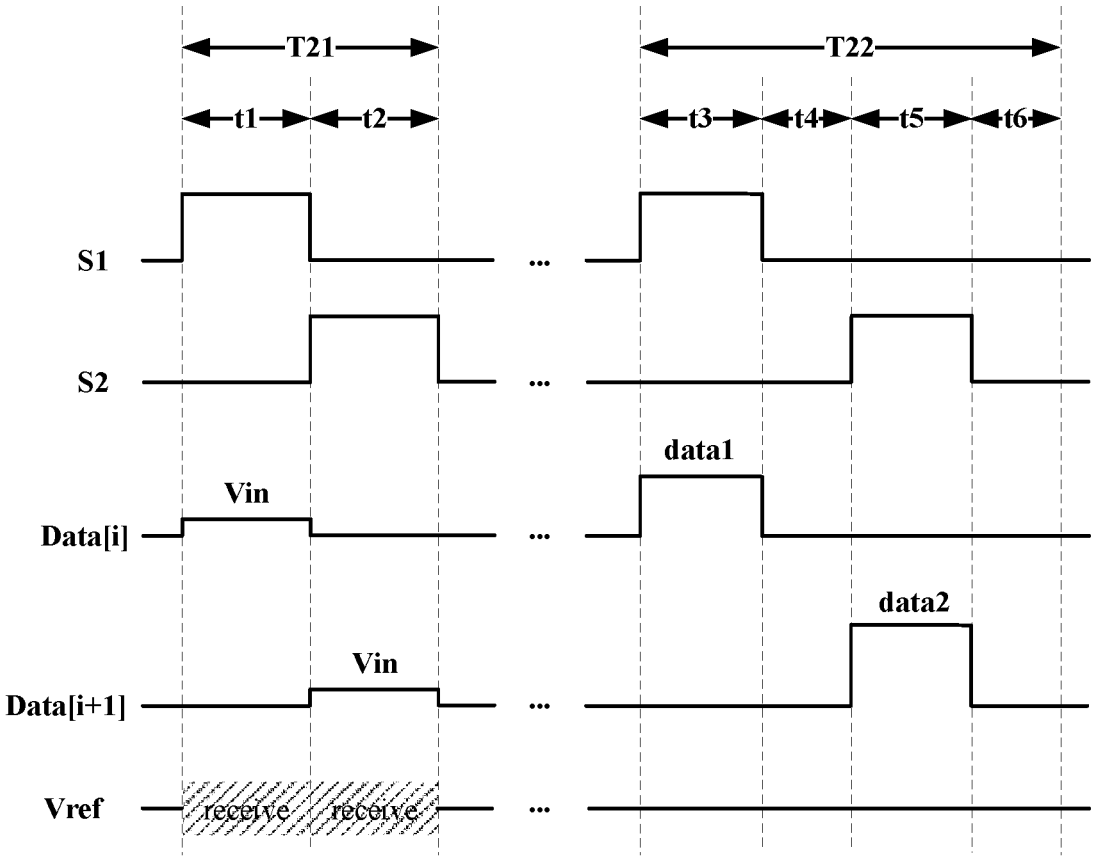
FIG. 10 illustrates a schematic time sequence diagram of the driving method shown in FIG. 9.

Hereunder, the working procedure of the driving method of the present embodiment is further described in conjunction with the structural diagram shown in FIG. 4A and the time sequence shown in FIG. 10. Illustration is presented below by taking an example in which the first level is a high level, the second level is a low level, and transistors in the pixel driving circuits each are an NMOS transistor.

In the first collecting phase t1 of the threshold detection phase T21, the first level signal is provided to the first control signal line S1, the second level signal is provided to the second control signal line S2, and a first initialization signal Vin is provided to the data voltage signal line Vdata (e.g., the data voltage signal line Vdata[i] in FIG. 4A). The first transistor M1 in the pixel driving circuit 410 is turned on, a potential of node N1 in the pixel driving circuit 410 VN1=Vin, and then the driving transistor DT in the pixel driving circuit 410 is turned on. The first voltage signal line PVDD charges the second electrode (node N2) of the driving transistor DT in the pixel driving circuit 410 until the potential of the node N2 rises to Vin−Vth1, the driving transistor DT in the pixel driving circuit 410 is turned off, whereupon the first voltage signal line PVDD stops charging. Then, the reference voltage signal line Vref is used to sample the potential of the second electrode (node N2) of the driving transistor DT in the pixel driving circuit 410 VN2=Vin−Vth1, to determine the threshold voltage Vth1 of the driving transistor DT in the pixel driving circuit 410. Here, Vin is a known potential, and it is possible to calculate the threshold voltage Vth1 of the driving transistor DT in the pixel driving circuit 410. The detected threshold voltage Vth1 of the driving transistor DT in the pixel driving circuit 410 may be stored in a memory. Here, the memory for example may be a memory in the interior of the organic light-emitting display panel.

In the second collecting phase t2 of the threshold detection phase T21, the second level signal is provided to the first control signal line S1, the first level signal is provided to the second control signal line S2, and a first initialization signal Vin is provided to the data voltage signal line Vdata (e.g., the data voltage signal line Vdata[i+1] in FIG. 4A). The first transistor M1 in the pixel driving circuit 420 is turned on, a potential of node N1 in the pixel driving circuit 420 VN1=Vin, the first voltage signal line PVDD charges the second electrode (node N2) of the driving transistor DT in the pixel driving circuit 420 until the potential of the node N2 rises to Vin−Vth2, whereupon the driving transistor DT is turned off, and the first voltage signal line PVDD stops charging. Then, the reference voltage signal line Vref is used to sample the potential of the second electrode (node N2) of the driving transistor DT in the pixel driving circuit 420 VN2=Vin−Vth1, to determine the threshold voltage of the driving transistor DT in the pixel driving circuit 420. Here, Vin is a known potential, and it is possible to calculate the threshold voltage Vth2 of the driving transistor DT in the pixel driving circuit 420. Likewise, the detected threshold voltage Vth2 of the driving transistor DT in the pixel driving circuit 420 may be stored in a memory.

As such, the threshold voltage of the driving transistors in the first pixel circuit, second pixel circuit and third pixel circuit may be detected through the aforesaid threshold detection phase T21.

Then, in a first data signal write phase t3 of the display phase T21, a first level signal is provided to the first control signal line S1, a second level signal is provided to the second control signal line S2, a reference voltage signal VRef is provided to the reference voltage signal line VREF, a first data signal data1 for compensating the threshold voltage vth1 of the driving transistor DT in the pixel driving circuit 410 is provided to the data voltage signal line Vdata (e.g., the data voltage signal line Vdata[i] in FIG. 4A), the reference voltage signal VRef is transmitted to the second electrode (node N2) of the driving transistor DT in the pixel driving circuit 410, and the first data signal data1 is transmitted to the gate (node N1) of the driving transistor DT in the pixel driving circuit 410. At this time, the potential of node N2 VN2=VRef and the potential of node N1 VN1=data1.

Then, in a first light-emitting phase t4 of the display phase T22, a second level signal is provided to the first control signal line S1, and the light-emitting diode OL in the pixel driving circuit 410, due to the action of the potential difference of node N1 and node N2, is turned on and emits light.

In a second data signal write phase t5 of the display phase T22, a second level signal is provided to the first control signal line S1, a first level signal is provided to the second control signal line S2, a second level signal is provided to the second control signal line S2, a reference voltage signal VRef is provided to the reference voltage signal line VREF, a second data signal data2 for compensating the threshold voltage vth2 of the driving transistor DT in the pixel driving circuit 420 is provided to the data voltage signal line Vdata (e.g., the data voltage signal line Vdata[i+1] in FIG. 4A), the reference voltage signal VRef is transmitted to the second electrode (node N2) of the driving transistor DT in the pixel driving circuit 420, and the second data signal data2 is transmitted to the gate (node N1) of the driving transistor DT in the pixel driving circuit 420. At this time, the potential of node N2 VN2=VRef and the potential of node N1 VN1=data2.

Then, in a second light-emitting phase t6 of the display phase T22, a second level signal is provided to the second control signal line S2, and the light-emitting diode OL in the pixel driving circuit 420, due to the action of the potential difference of node N1 and node N2, is turned on and emits light.

In the first threshold detection phase t1 and first data signal write phase t3, the first control signal line S1 transmits the first level signal and turns off the second transistor M2 in the pixel driving circuit 420. In T11 or T12, the pixel driving circuit 420 does not affect the signal of the reference voltage signal line Vref, that is, the threshold voltage Vth1 of the driving transistor DT in the pixel driving circuit 410 collected by the reference voltage signal line Vref does not undergo interference of the pixel driving circuit 420, and the first data signal transmitted by the data voltage signal line to the second electrode (node N2) of the driving transistor DT in the pixel driving circuit 410 does not undergo interference of the pixel driving circuit 420.

Likewise, in the second threshold detection phase t2 and second data signal write phase t4, the collection of the threshold voltage of the driving transistor DT in the pixel driving circuit 420 and write of the second data signal is not affected by the pixel driving circuit 410.

In addition, in the first light-emitting phase (step 940) of the driving method of the present embodiment, to enable the light-emitting diodes in the first pixel driving circuit and third pixel driving circuit to emit light, the second level signal is provided to the first control signal line, and in this phase, no matter whether the first level signal or second level signal is applied to the second control signal line, no influence is exerted on light emission of the light-emitting diodes in the first pixel driving circuit and third pixel driving circuit. On the other hand, in the second data signal write phase (step 950), to write the second data signal to the second pixel driving circuit without affecting the first pixel driving circuit and third pixel driving circuit, it is necessary to provide the second level signal to the first control signal line and provide the first level signal to the first control signal line. As can be seen from the above, in the present embodiment, the first light-emitting phase and second data write phase may be performed simultaneously, or the first light-emitting phase and the second data write phase at least have a partially overlapped time period. That is, during light emission of the light-emitting diodes in the first pixel driving circuit and third pixel driving circuit based on the first data signal in the present embodiment, the second data signal may be written into the second pixel driving circuit. For example, in FIG. 10, phase t4 and phase t5 may partially overlap even completely overlap. As such, it is possible enable a shorter time length spent in completing the data write and light emission of respective pixel driving circuits of the whole organic light-emitting display panel, thereby facilitating improvement of a frame frequency of the organic light-emitting display panel so that the displayed images are more coherent.

In some optional implementation modes of the driving method of the present embodiment, when the organic light-emitting display panel using the driving method of the present embodiment has a structure as shown in FIG. 5C, since the first control signal line in a certain row of the organic light-emitting display panel is multiplexed as the second control signal line of the preceding row, the first pixel driving circuit in the $i^{th}$ row and the second pixel driving circuit in the $(i-1)^{th}$ row of the organic light-emitting display panel may be in the same working phase. That is to say, when the first pixel driving circuit and third pixel driving circuit in the $i^{th}$ row are in the threshold detection phase (corresponding to phase t1 in FIG. 10), the second pixel driving circuit in the $i-1^{th}$ row is also in the threshold detection phase (corresponding to phase t2 in FIG. 10); when the first pixel driving circuit and third pixel driving circuit in $i^{th}$ row are in the data write phase (corresponding to phase t3 in FIG. 10), the second pixel driving circuit in the $(i-1)^{th}$ row is also in the data write phase (corresponding to phase t5 in FIG. 10); when the first pixel driving circuit and third pixel driving circuit in the $i^{th}$ row are in the light-emitting phase (corresponding to phase t4 in FIG. 10), the second pixel driving circuit in the $i-1^{th}$ row is also in the light-emitting phase (corresponding to phase t6 in FIG. 10).

As such, after the driving method of the present embodiment is employed, with level-by-level output of the shift register units, the organic light-emitting display panel also correspondingly complete gradual refresh and display.

In addition, after the organic light-emitting display panel is communicated with the power supply, it is feasible to, in the threshold detection phase T21, detect the threshold voltage of the respective driving transistors in the panel, and store the detected threshold voltage in a memory in a manner such as listing. In the display phase T22, it is feasible to look up in the memory for the threshold voltage values of the driving transistors in the respective pixel driving circuits, thereby determining the corresponding data signal for compensating the threshold voltage. Here, the threshold voltage may be detected only once after the power supply is turned on, and the threshold voltage needn't be detected again upon displaying each frame of images. The driving method of the present embodiment may not only reduce the load of the reference voltage signal line and reduce the number of ports of the driving chip occupied by the reference voltage signal line, but also provide more time for the display phase of each frame of images, thereby ensuring that nodes in the pixel driving circuits are charged to sufficient potential, and boosting stability in displaying images. On the other hand, the time period for displaying each frame of images may be shortened, display and scanning of a larger number of pixel driving circuits may be completed in a unit time period, and therefore the driving method may be adapted to drive the organic light-emitting display panel having a higher resolution.

It needs to be appreciated that in the driving method in embodiments of the present disclosure, the reference voltage signal line is used to perform collection of the threshold voltage of the driving transistor. Therefore, to ensure that the collected voltage of the anode of the light-emitting diode is not subject to interference of the original electrical signal on the reference voltage signal line, it is feasible to perform a reset operation for the reference voltage signal line first (e.g., to ground the reference voltage signal line or provide a reference voltage signal to the reference voltage signal line) before using the reference voltage signal line to collect the voltage of the anode of the light-emitting diode for the first time. When the reference voltage signal line is used subsequently to collect the threshold voltage of the driving transistor, since the reference voltage signal line alternatingly works in two working sates, namely, collecting the threshold voltage of the driving transistor, and providing the reference voltage signal to the anode of the light-emitting diode, the reset operation is performed for the reference voltage signal line before collecting each time. Hence, it is unnecessary to additionally increase the reset operation for the reference voltage signal line before collecting each time subsequently.

What have been described above are only preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. An organic light-emitting display panel, comprising:

a pixel array comprising pixel regions in M rows and N columns, M and N each being an integer greater than or equal to 2;

a plurality of pixel driving circuits, each pixel driving circuit comprising a light-emitting diode and a driving transistor for driving the light-emitting diode;

a plurality of reference voltage signal lines for providing a reference voltage signal to the plurality of pixel driving circuits; and a plurality of data voltage signal lines for providing a data voltage signal to the plurality of pixel driving circuits;

wherein the plurality of pixel driving circuits comprise a first pixel driving circuit, a second pixel driving circuit and a third pixel driving circuit, the first pixel driving circuit and the second pixel driving circuit are adjacent to each other in a row direction of the pixel array, and the second pixel driving circuit and the third pixel driving circuit are adjacent to each other in the row direction of the pixel array;

wherein the first pixel driving circuit and the second pixel driving circuit share one of the plurality of reference voltage signal lines, and the second pixel driving circuit and the third pixel driving circuit share one of the plurality of data voltage signal lines; and wherein the organic light-emitting display panel further comprises a first control signal line and a second control signal line, the first pixel driving circuit and the third pixel driving circuit receive the reference voltage signal and the data voltage signal and turn on the light-emitting diodes in the first pixel driving circuit and the third pixel driving circuit under control of a first control signal input from the first control signal line, and the second pixel driving circuit receives the reference voltage signal and the data voltage signal and turns on the light-emitting diode in the second pixel driving circuit under control of a second control signal input from the second control signal line.

2. The organic light-emitting display panel according to claim 1, wherein the pixel array further comprises at least one pixel sub-array;

wherein the pixel sub-array comprises a first pixel column, a second pixel column and a third pixel column, the first pixel column is adjacent to the second pixel column, and the second pixel column is adjacent to third pixel column;

the plurality of pixel driving circuits comprise a plurality of first pixel column driving circuits, a plurality of second pixel column driving circuits and a plurality of third pixel column driving circuits;

wherein the first pixel driving circuits are configured to drive the pixel regions in the first pixel column, the second pixel driving circuits are configured to drive the pixel regions in the second pixel column, and the third pixel driving circuits are configured to drive the pixel regions in the third pixel column.

3. The organic light-emitting display panel according to claim 2, wherein any pixel column in the pixel array is one of the first pixel columns, second pixel columns and third pixel columns, and any first pixel column is not adjacent to any third pixel column.

4. The organic light-emitting display panel according to claim 3, wherein each of the pixel driving circuits comprises a first transistor, a second transistor and a first capacitor;

wherein a first electrode of the first transistor is electrically connected with one of the data voltage signal lines, and a second electrode of the first transistor is electrically connected with a gate of the driving transistor;

wherein a first electrode of the driving transistor is electrically connected with a first voltage input signal line, and a second electrode of the driving transistor is electrically connected with a second electrode of the second transistor and an anode of the light-emitting diode;

wherein a first electrode of the second transistor is electrically connected with one of the reference voltage signal lines;

wherein two electrodes of the first capacitor are respectively connected with the gate of the driving transistor and the second electrode of the second transistor; and wherein a cathode of the light-emitting diode is electrically connected with a second voltage input signal line.

5. The organic light-emitting display panel according to claim 4, wherein in the first pixel driving circuit and third pixel driving circuit, the gate of the first transistor and the gate of the second transistor are electrically connected with the first control signal line; and in the second pixel driving circuit, the gate of the first transistor and the gate of the second transistor are electrically connected with the second control signal line.

6. The organic light-emitting display panel according to claim 5, further comprising a shift register;

wherein the shift register comprises a plurality of cascaded shift register units;

wherein each of the shift register units is electrically connected with one of the first control signal line and the second control signal line; and wherein the first pixel driving circuit and third pixel driving circuit in a same row are electrically connected with a same first control signal line, and the second pixel driving circuits in a same row are electrically connected with a same second control signal line.

7. The organic light-emitting display panel according to claim 6, wherein a $k^{th}$ shift register unit is configured to provide the first control signal to the first control signal line in a $i^{th}$ row, and a $(k+1)^{th}$ shift register unit is configured to provide the first control signal to the second control signal line in the $i^{th}$ row, wherein $1 \leq i \leq M$.

8. The organic light-emitting display panel according to claim 7, wherein the first control signal line in a $(j+1)^{th}$ row is multiplexed as the second control signal line in a $j^{th}$ row;

wherein j is a natural number and satisfies $1 \leq j \leq M-1$.

9. An organic light-emitting display device, comprising the organic light-emitting display panel according to claim 1.

10. The organic light-emitting display device according to claim 9, wherein the organic light-emitting display device is a top emission organic light-emitting display device.

11. The organic light-emitting display device according to claim 9, wherein the organic light-emitting display device is a bottom emission organic light-emitting display device.

12. A method for driving an organic light-emitting display panel as in claim 1, wherein the method comprises:

in a first phase, providing a first level signal to the first control signal line, providing a second level signal to the second control signal line, providing a first initialization signal to each of the data voltage signal lines electrically connected with the first pixel driving circuit and third pixel driving circuit, and performing initialization and threshold detection for the first pixel driving circuit and third pixel driving circuit;

in a second phase, providing a first voltage level signal to the first control signal line, providing a second voltage level signal to the second control signal line, providing a reference voltage signal to the reference voltage signal line, and providing a first data signal for compensating a threshold voltage of the driving transistor of the first pixel driving circuit or third pixel driving circuit to the data voltage signal lines electrically connected with the first pixel driving circuit and third pixel driving circuit, respectively;

in a third phase, providing the second level signal to the first control signal line, providing the first level signal to the second control signal line, providing a first initialization signal to the data voltage signal line electrically connected with the second pixel driving circuit, thereby performing initialization and threshold detection for the second pixel driving circuit, and emitting light by the light-emitting diodes in the first pixel driving circuit and third pixel driving circuit based on the first data signal;

in a fourth phase, providing the second level signal to the first control signal line, providing the first voltage level signal to the second control signal line, providing a reference voltage signal to the reference voltage signal line, and providing a second data signal for compensating a threshold voltage of the driving transistor of the second pixel driving circuit to the data voltage signal line electrically connected with the second pixel driving circuit; and in a fifth phase, emitting light by the light-emitting diode in the second pixel driving circuit based on the second data signal.

13. A method for driving an organic light-emitting display panel as in claim 1, wherein the method comprises:

in a first collecting phase of a threshold detection phase, providing a first voltage level signal to the first control signal line, providing a second voltage level signal to the second control signal line, providing a first initialization signal to the data voltage signal lines electrically connected with the first pixel driving circuit and third pixel driving circuit, respectively, thereby performing initialization and threshold detection for the first pixel driving circuit and third pixel driving circuit; and in a second collecting phase of the threshold detection phase, providing the second voltage level signal to the first control signal line, providing the first voltage level signal to the second control signal line, providing a first initialization signal to the data voltage signal line electrically connected with the second pixel driving circuit, thereby performing initialization and threshold detection for the second pixel driving circuit.

14. The method according to claim 13, further comprising:

in a first data signal write phase of a display phase, providing a first level signal to the first control signal line, providing a second level signal to the second control signal line, providing a reference voltage signal to the reference voltage signal line, and providing a first data signal for compensating a threshold voltage of the driving transistor of the first pixel driving circuit or third pixel driving circuit to the data voltage signal lines electrically connected with the first pixel driving circuit and third pixel driving circuit, respectively;

in a first light-emitting phase, providing a second voltage level signal to the first control signal line, and emitting light by the light-emitting diodes in the first pixel driving circuit and third pixel driving circuit based on the first data signal;

in a second data signal write phase of the display phase, providing the second voltage level signal to the first control signal line, providing the first voltage level signal to the second control signal line, providing a reference voltage signal to the reference voltage signal line, and providing a second data signal for compensating a threshold voltage of the driving transistor of the second pixel driving circuit to the data voltage signal line electrically connected with the second pixel driving circuit; and in a second light-emitting phase, providing a second voltage level signal to the second control signal line, and emitting light by the light-emitting diode in the second pixel driving circuit based on the second data signal.

* * * * *